US006022096A

United States Patent [19]

Hirasawa et al.

[11] Patent Number: 6,022,096

[45] **Date of Patent: *Feb. 8, 2000**

[54] COLOR RECORDING APPARATUS AND METHOD

[75] Inventors: Shinichi Hirasawa, Sagamihara; Kenichirou Hashimoto, Yokohama; Kunihiko Maeoka, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/454,814

[22] Filed: May 31, 1995

[30] Foreign Application Priority Data

May 31, 1994 [JP] Japan ..... 6-119267

[51] Int. Cl.[7] ..... B41J 2/21; B41J 29/38

[52] U.S. Cl. ..... 347/43; 347/9; 347/14

[58] Field of Search ..... 347/43, 15, 40, 347/104, 105, 101, 14, 9; 346/138, 139 D

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,728,968 | 3/1988 | Hillmann et al. | 347/10 |
| 4,740,796 | 4/1988 | Endo et al. | 347/56 |
| 5,455,610 | 10/1995 | Harrington | 347/43 |

FOREIGN PATENT DOCUMENTS

| | | |
|---|---|---|
| 0401575 | 12/1990 | European Pat. Off. . |
| 0517519 | 12/1992 | European Pat. Off. . |
| 0532270 | 3/1993 | European Pat. Off. . |
| 0595657 | 5/1994 | European Pat. Off. . |
| 3412531 | 10/1985 | Germany . |
| 54-56847 | 5/1979 | Japan . |
| 59-123670 | 7/1984 | Japan . |
| 59-138461 | 8/1984 | Japan . |
| 60-71260 | 4/1985 | Japan . |
| 61-104856 | 5/1986 | Japan . |
| 62-56151 | 3/1987 | Japan . |
| 1-12675 | 1/1989 | Japan . |
| 6-135007 | 5/1994 | Japan . |
| 6-135014 | 5/1994 | Japan . |
| 90-02925 | 3/1990 | WIPO . |

*Primary Examiner*—N. Le
*Assistant Examiner*—Thinh Nguyen
*Attorney, Agent, or Firm*—Fitzpatrick, Cella, Harper & Scinto

[57] ABSTRACT

An ink jet recording method wherein ink is ejected onto a recording material, includes providing an ink jet head having a predetermined number of first ejection outlets for ejecting black ink and a smaller number of second ejection outlets for ejecting ink different from the black ink; effecting recording operation, while scanningly moving the ink jet head in a direction different from a direction in which the recording material is fed, using m second ejection outlets, m+k or m−k first ejection outlets; feeding the recording material through mxp, where p is an interval at which the ejection outlets are arranged; shifting a range of use of the first ejection outlets in a direction of feeding of the recording material; and repeating said recording, feeding and shifting steps.

10 Claims, 8 Drawing Sheets

COLOR RECORDING APPARATUS AND METHOD

FIELD OF THE INVENTION AND RELATED ART

The present invention relates to a color recording apparatus and method, more particularly to an ink jet recording apparatus and method capable of recording a full-color image recording using black and other color inks.

A color recording system using a plurality of ejection outlets (multi-ejection outlet head) includes the one using three primary color inks (cyan, magenta, yellow, for example), and the one using the same color inks plus black (four color in total). The ink jet heads for ejecting multiple inks may be separate for respective color inks, or an integral head for ejecting the three color inks or the three color inks plus black inks.

As a recording system using the color inks including the black inks, is disclosed in Japanese Patent Application Publication No. 12675/1989, for example. Here, the recording material is moved through a width corresponding to the recording width for each color, relative to a recording head having three ejection outlet groups arranged in a sub-scan direction. It discloses use of black ink, but does not disclose actual recording method or number of ejection outlets.

In Japanese Laid-Open Patent Applications Nos. 104856/1986 and 56151/1987, disclose that four color ejection outlets are disposed in a main scan direction, wherein the number of ejection outlets for the black ink is larger than that of the three primary colors. Here, the number of ejection outlets for the black ink is larger than that for each of the three primary colors so as not to decrease a character recording speed. However, it does not disclose how to use the black ink ejection outlet during the color recording. Japanese Laid-Open Patent Applications No. 135007/1994 and 135014/1994 disclose that four color ejection outlet groups are disposed in the sub-scan direction, wherein the number of ejection outlets for the black ink is larger than that for the three primary color ejection outlets. In these publications, although the number for the ejection outlets for the black ink is larger, the number of used black ejection outlets is the same as that for each of the three primary colors, that is, only part of the black ink ejection outlets is used.

In this case, among the black ejection outlets, the use frequencies are different between the ones used in the color recording and the ones not used in the color recording with the result of difference in the service life of the ejection outlets. As a result, the service life of the black ejection outlets is determined by the service life of the ejection outlets frequently used.

SUMMARY OF THE INVENTION

Accordingly, it is a principal object of the present invention to provide a color recording apparatus and method wherein the service life of the black ejection outlets is long by efficient use of the black ejection outlets, the number of which is larger than for the other colors.

It is another object of the present invention to provide a color recording apparatus and method wherein the time required prior to the start of the recording can be shortened by simplifying the data processing prior to the recording for the purpose of associating the recording data and each color ejection outlets, or other processing.

It is a further object of the present invention to provide a color recording apparatus and method capable of increasing the recording speed by decreasing the scanning range of the recording head in the main scan direction.

According to an aspect of the present invention, there is provided an ink jet recording method wherein ink is ejected onto a recording material, comprising: providing an ink jet head having a predetermined number of first ejection outlets for ejecting black ink and a smaller number of second ejection outlets for ejecting ink different from the black ink; effecting recording operation, while scanningly moving the ink jet head in a direction different from a direction in which the recording material is fed, using m second ejection outlets, m+k or m−k first ejection outlets; feeding the recording material through mxp, where p is an interval at which the ejection outlets are arranged; shifting a range of use of the first ejection outlets in a direction of feeding of the recording material; and repeating said recording, feeding and shifting steps.

According to another aspect of the present invention, there is provided an ink jet recording method wherein ink is ejected onto a recording material to record an image which is divided into an area to be recorded by black ink and an area to be recorded by ink different from the black ink, comprising: providing an ink jet head having a predetermined number of first ejection outlets for ejecting the black ink and a number, which is not more than one third of the predetermined number, of second ejection outlets for ejecting the ink different from the black ink; effecting recording operation, while scanningly moving the ink jet head in a direction different from a direction in which the recording material is fed, using m second ejection outlets; feeding the recording material through mxp, where p is an interval at which the ejection outlets are arranged; and repeating said recording, feeding and shifting steps; wherein when qxm ($q \geqq 3$) of said first ejection outlets are faced to an area to be recorded with black ink, said ink jet head are moved to the area, and the black ink is ejected through the first election outlets.

According to a further aspect of the present invention, there is provided a color recording apparatus comprising a recording head having a first number of first recording elements for effecting recording with black ink and a second number of second recording elements for effecting recording with ink different from the black ink; scanning means for scanning a recording material with said recording head in a direction different from a direction in which said recording elements are arranged; feeding means for feeding the recording material in the different direction through a width in which the second number of second recording elements; selecting means for selecting, for each scan of said scanning means, from said first recording elements the elements to be used during a period of scan by said scanning means, wherein the number of the selected elements is different from the second number, and said selecting means shifting the selected elements.

According to a further aspect of the present invention, there is provided a color recording apparatus comprising a recording head having a first number of first recording elements for effecting recording with black ink and x (>1) groups of second numbers of second recording elements for effecting recording with inks different from the black ink; scanning means for scanning a recording material with said recording head in a direction different from a direction in which said recording elements are arranged; feeding means for feeding the recording material in the different direction through a width in which the second number of second recording elements; selecting means for selecting, for each scan of said scanning means, from said first recording elements the elements and from said x groups of the second recording elements the elements, to be used during a period of scan by said scanning means, such that all of the first recording elements are used when said scanning means scans through a distance corresponding to a predetermined number of said first recording elements.

According to an aspect of the present invention, the number of black ink ejection outlets beyond the number of another color ink ejection outlets, are used all at once while deviating with a predetermined numbers, and therefore, the service life difference between individual black ink ejection outlets.

The number of ejection outlets used for the black and the other colors can be substantially constant at all times so that the time period required for the recording data processing can be reduced, or when the black ink is not ejected, the scanning range with the ink jet head can be reduced, and therefore, the recording speed is increased.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described in detail.

Figure 1:
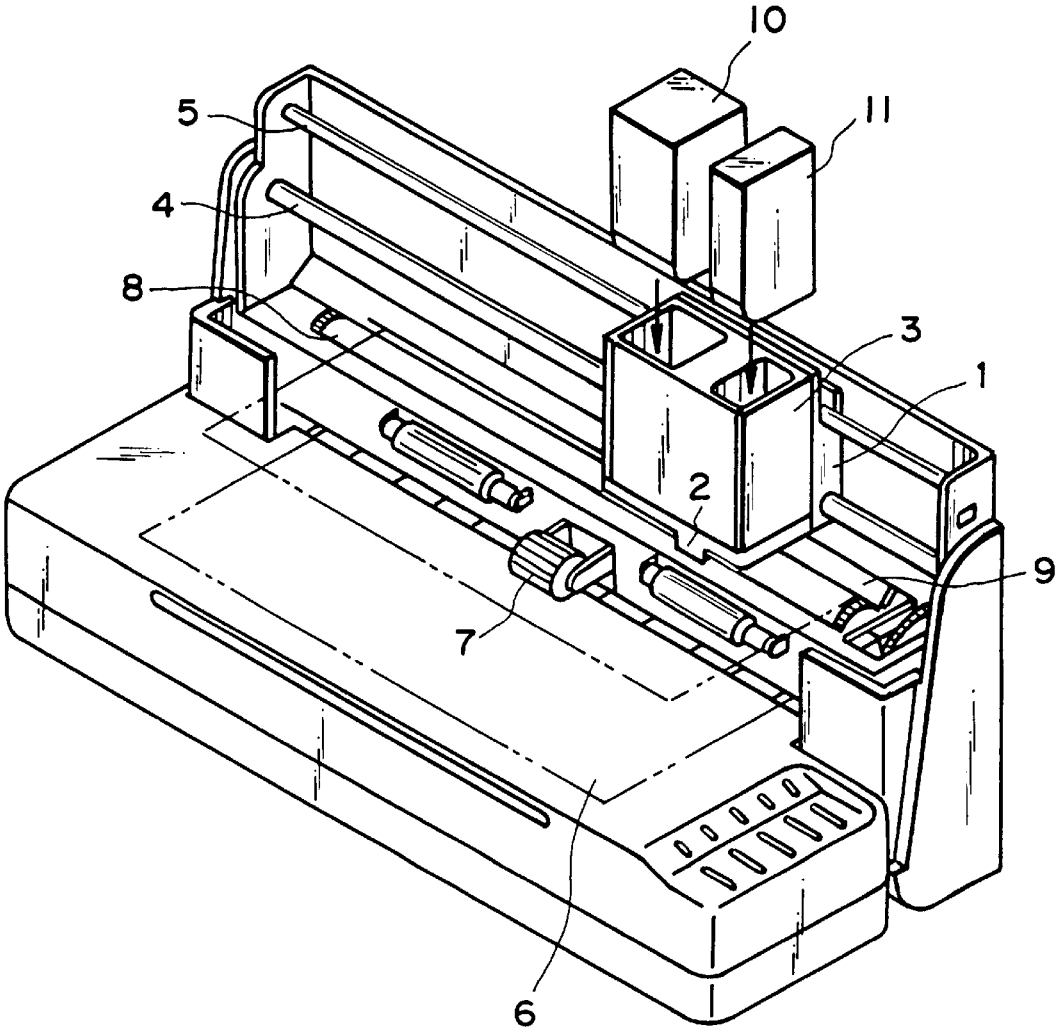
FIG. 1 is a perspective view of a color ink jet recording apparatus to which the present invention is applicable.

FIG. 1 is a perspective view of a color ink jet recording apparatus to which the present invention is usable.

In FIG. 1, a carriage 1 is engaged with a guiding shaft 5 and a lead screw 4, and is moved in parallel by rotation of the lead screw 4 in synchronism with a carriage motor 508. On the carriage 1, an ink jet head (head) 2 is fixed, and a color ink cartridge 10 and a black ink cartridge 11 are detachably mountable along a cartridge guide 3 so as to permit ink supply to the head 2.

The ink ejected from the head 2 is received by the recording material namely a recording sheet 6 faced to the head 2, so that an image is formed. The recording material 6 is fed properly by cooperation among a sheet feeding roller 7, a sheet discharging roller 8 and a sheet confining plate 9 by an unshown motor.

Embodiment 1

Figure 2:
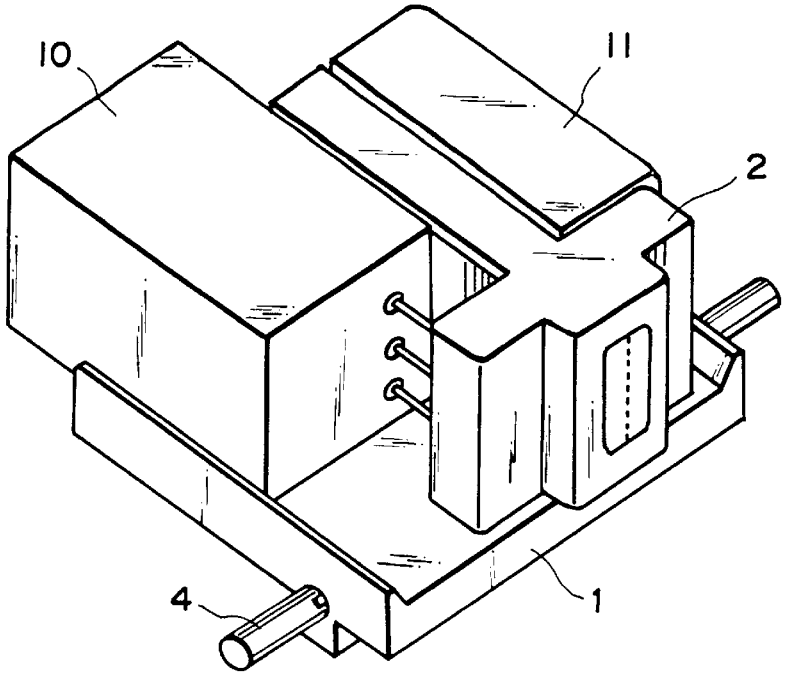
FIG. 2 is a perspective view of details of carriage 1 used in this embodiment.

FIG. 2 is a perspective view of a carriage 1. In this Figure, (*a*) and (*b*) are perspective views of the head 2, and (*a*) is the view as seen from the opposite side from the side having the ejection outlets, and (*b*) is a view as seen from the ejection outlet side.

Figure 3A:
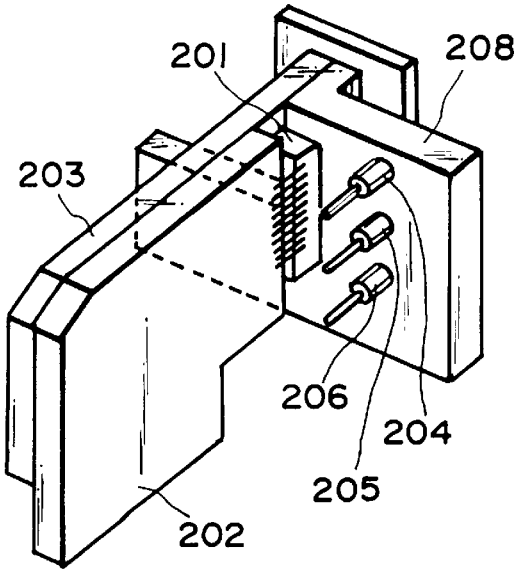
FIGS. 3A–3B is a perspective view of an ink jet head 2 used in this embodiment.
Figure 3B:
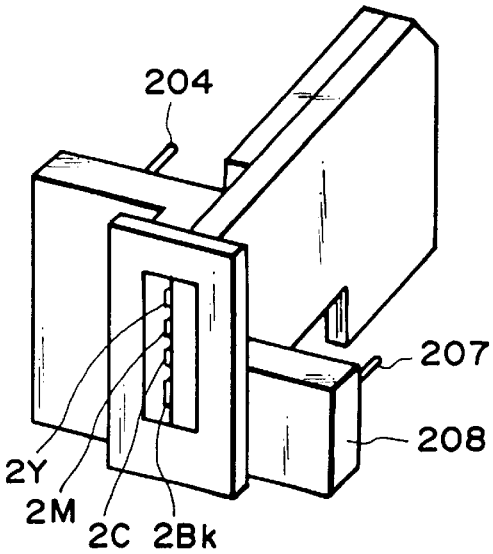

The color ink cartridge 10 and the black ink cartridge 11 are mounted from the rear of the head 2, and the yellow, magenta, cyan and black inks are supplied through pipes 204, 205, 206 and 207 as shown in FIG. 3, (*a*) and (*b*).

Thus, the color ink cartridge 10 contains cyan, magenta and yellow inks in respective ink chambers in one casing, and the black ink cartridge 11 contains the black ink.

Designated by 201 is a silicone substrate having heaters or the like for ejecting the ink, and 202 is a print board having driving circuits for the head 2, and 203 is an aluminum plate on which the silicone substrate 201 and the print board 202 are fixed.

The pipes 204, 205, 206 and 207 function to supply the inks from the color ink cartridge 10 and the black ink cartridge 11 to the ejecting portion of the recording heads 2 through a distributor 208. The head 2 is provided with yellow, cyan, magenta, black ink ejection outlet groups 2Y, 2M, 2C and 2BK, and each of the groups is arranged on one line in the sub-scan direction (in the feeding direction of the recording sheet 6 in FIG. 1). The number of ejection outlets is 24 for group 2Y, 24 for group 2M, 24 for group 2C and 64 for group 2BK. Between the ejection outlet groups 2Y and 2M, and between the ejection outlet groups 2M and 2C, there are intervals corresponding to 8 ejection outlet intervals, respectively. Between the ejection outlet groups 2C and 2BK, an interval corresponding to 16 ejection outlet intervals, are provided.

In this embodiment, the feeding amount per one scan for the recording material for a monochromatic recording, corresponds to a recording width of the black ejection outlet group, namely 64 ejection outlets. For color recording, it corresponds to the recording width of the color ejection outlet group, that is, 24 ejection outlets.

Figure 4:
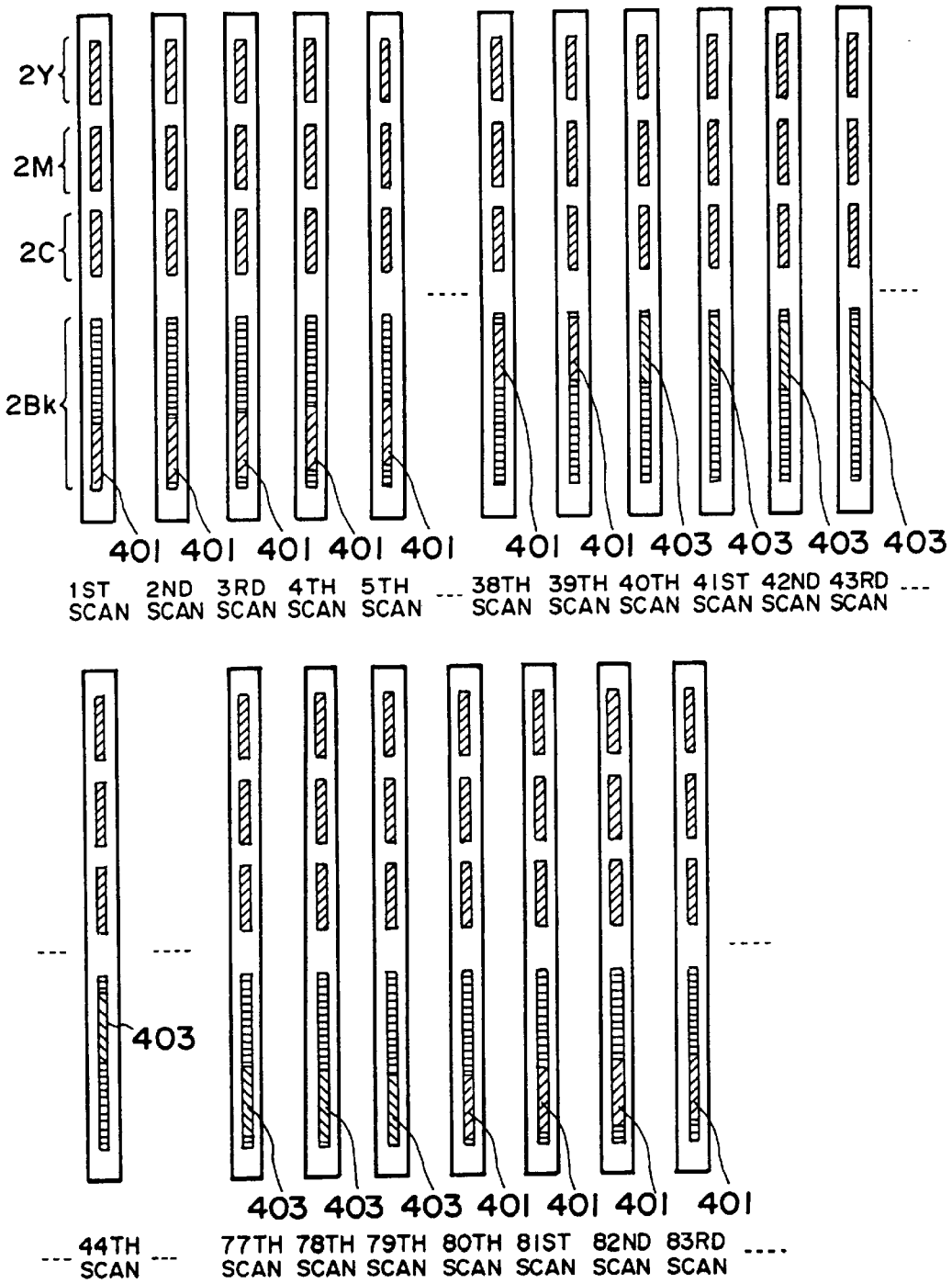
FIG. 4 illustrates a recording operation in the apparatus of Embodiment 1.

FIG. 4 illustrates ejection outlet side of the head 2 for the purpose of illustrating how to use each color ejection outlet in the color recording. In this Figure, first scan may be any scan during a recording, and may be the first scan upon the start of the recording operation.

In FIG. 4, reference numerals 401 and 403 indicate black ejection outlet line used for each scan. In the first scan, bottom 23 nozzles as counted from the bottom of the ejection outlet group 2BK, namely, nozzle numbers 1–23, are used. After the sub-scan operation for 24 nozzles, nozzles No. 2–24 (deviated by one nozzle from the bottom) are used in the second scan. Subsequently, the similar operations are repeated up to the 39th scan when the using nozzles 401 reaches the top. The recording operation continues from the 40th scan using 25 ejection outlets 403, when the ejection outlets group 403 reaches the bottom at 79th scan, the use is made with the ejection outlets group including 23 ejection outlets, from the 80th scan. This is repeated until the end of the recording operation.

Figure 5:
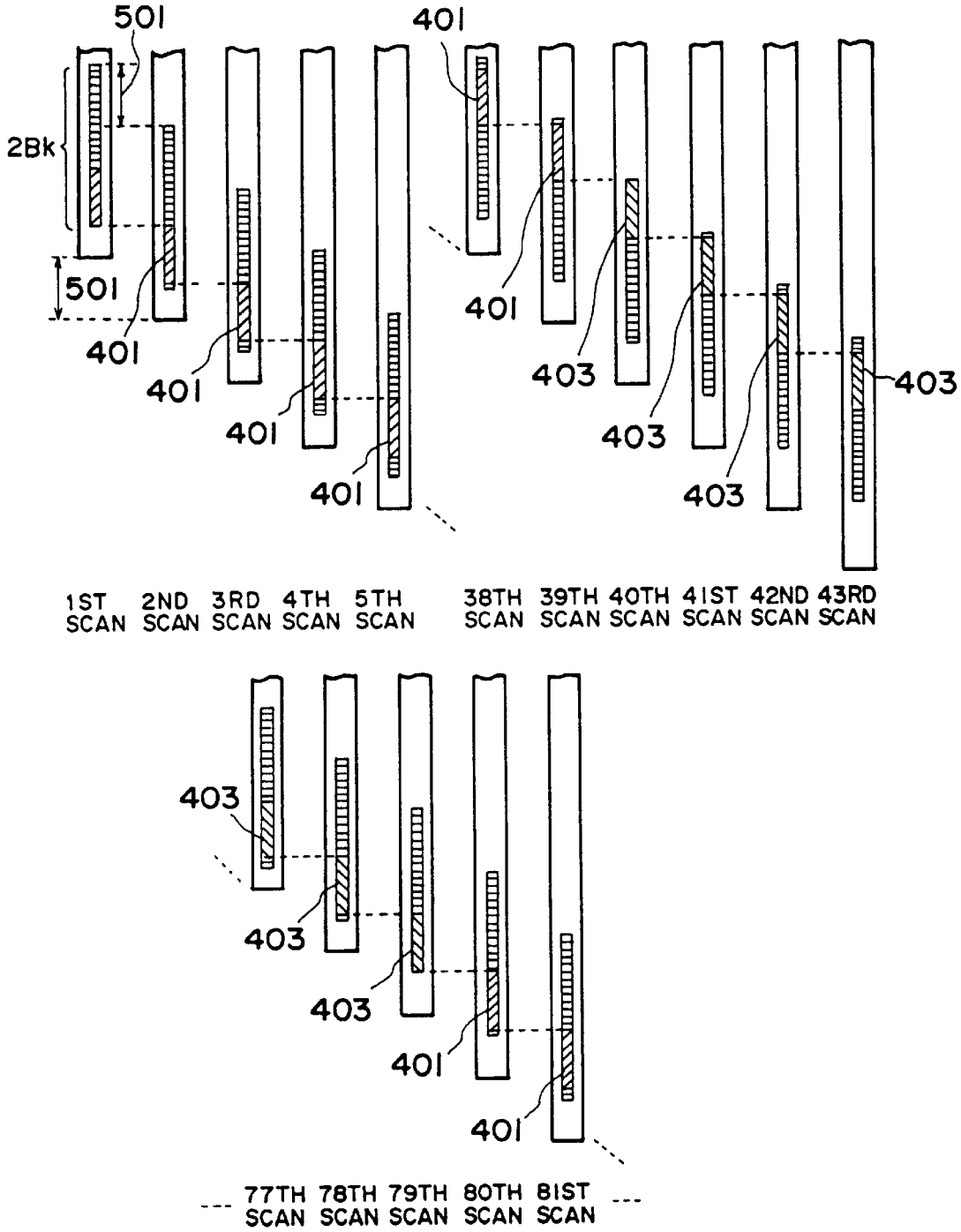
FIG. 5 illustrates more in detail the operation in Embodiment 1.

FIG. 5 illustrates in more detail the use of the black ejection outlets shown in FIG. 4.

FIG. 5 shows how to use the black ejection outlets in the case of the recording width corresponding to 24 ejection outlets (m=24) per one color. In the large number case an ejection outlet group or section 403 including 25 (m+1=25) out of 64 ejection outlets is used, and in the small number case, an ejection outlet section 401 including 23 (m−1=23) ejection outlets are used, for example.

In this Figure, for the purpose of simplification of the explanation, only black ejection outlets are shown, and the movement of the recording sheet 6 is indicated as the movement of the ejection outlets 2 BK (head 2) through the amount of movement of the recording sheet. The movement amount 501 of the recording sheet per one main scan corresponds to 24 ejection outlets corresponding to a recording width of the Y, M or C ejection outlets. In the following explanation, the number of ejection outlets is counted from the bottom.

In FIG. 5, if the 23 ejection outlets from the bottom, namely, ejection outlets 1–23 are used in the first scan, the recording sheet is moved through a distance corresponding to 24 ejection outlets (501), and then, the second scanning operation is carried out, using ejection outlets 2–24. By doing so, the boundary between recording regions of the adjacent scanning operations, are made continuous. During the third scan, ejection outlet 3–25, and ejection outlets 4–26 are used, and for the 39th scanning operation, ejection outlets 41–63 are used. At this time, the number of ejection outlets remaining in the upper part is 1, and from the next 40th scanning operation, the number of used ejection outlets is 25, that is, the recording operation is carried out using ejection outlets Nos. 40–64, first, in the 42th scan, 25 ejection outlets namely ejection outlets Nos. 39–63 are used for the movement amount of the recording sheet corresponding to 24 ejection outlets, in consideration of the continuation of the recording areas. With continuance of the recording operations, the used ejection outlets in the 79th scan are the outlets Nos. 1–25, that is, it reaches the bottom end. From the 80th scan after arrival to the bottom end, the number of used ejection outlets is 23.

As described in the foregoing, the using range of the ejection outlets for the black ink is shifted by the number of ejection outlets corresponding to the difference between the movement distance of the recording material and the recording width of the black ejection outlet section, so that the boundary between the recording areas is made continuous, and in addition, all of the large number of ejection outlets can be used. By doing so, the above-described problem of the difference in the service lives can be eliminated. Additionally, the difference in the numbers of the using ejection outlets for the black ink and the color ink is small (k: 1 in this embodiment), and therefore, the data processing operation before the recording is simplified, thus increasing the recording speed.

In the foregoing description, the case of the larger number of ejection outlets by one ejection outlet than the recording material feeding distance, or the case of smaller number of ejection outlets. However, the present invention is applicable to the combination of the larger number case and the smaller number case, and therefore, the smaller number case may use 22 ejection outlets while using 26 ejection outlets for the larger number case. In this case, the amount of shift of the section of the using ejection outlets corresponds to 2 ejection outlets which is difference from the number of ejection outlets corresponding to the feeding distance.

It is not inevitable to fix the number of using ejection outlets. For example, the number of using ejection outlets is changed in the following manner; 23 ejection outlets for the first scan, 22 ejection outlets for the second scan after shifting upwardly by ejection outlet, 21 for the third scan after shifting by two ejection outlets, and 20 ejection outlets for the fourth scan after shifting by 3 ejection outlets.

Thus, when the using section of the ejection outlets is shifted upwardly, the number of using ejection outlets is smaller than the number corresponding to the feeding distance, whereas when the section is shifted downwardly, a larger number of ejection outlets are used for the recording. By doing so, the using section of the ejection outlets can be moved.

Embodiment 2

Figure 6:
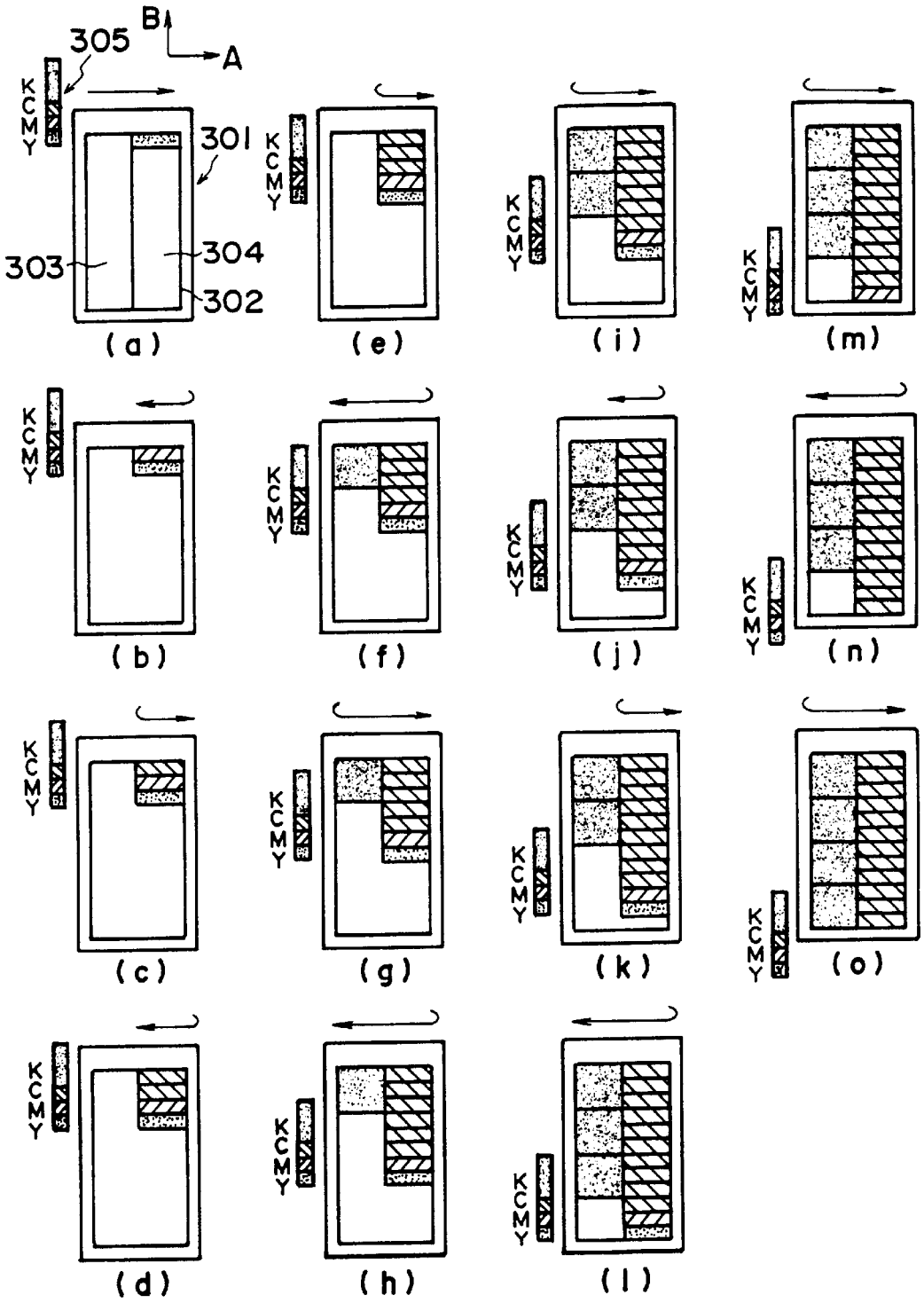
FIGS. 6A–6O illustrates a recording operation in an apparatus according to Embodiment 2 of the present invention.
Figure 7:
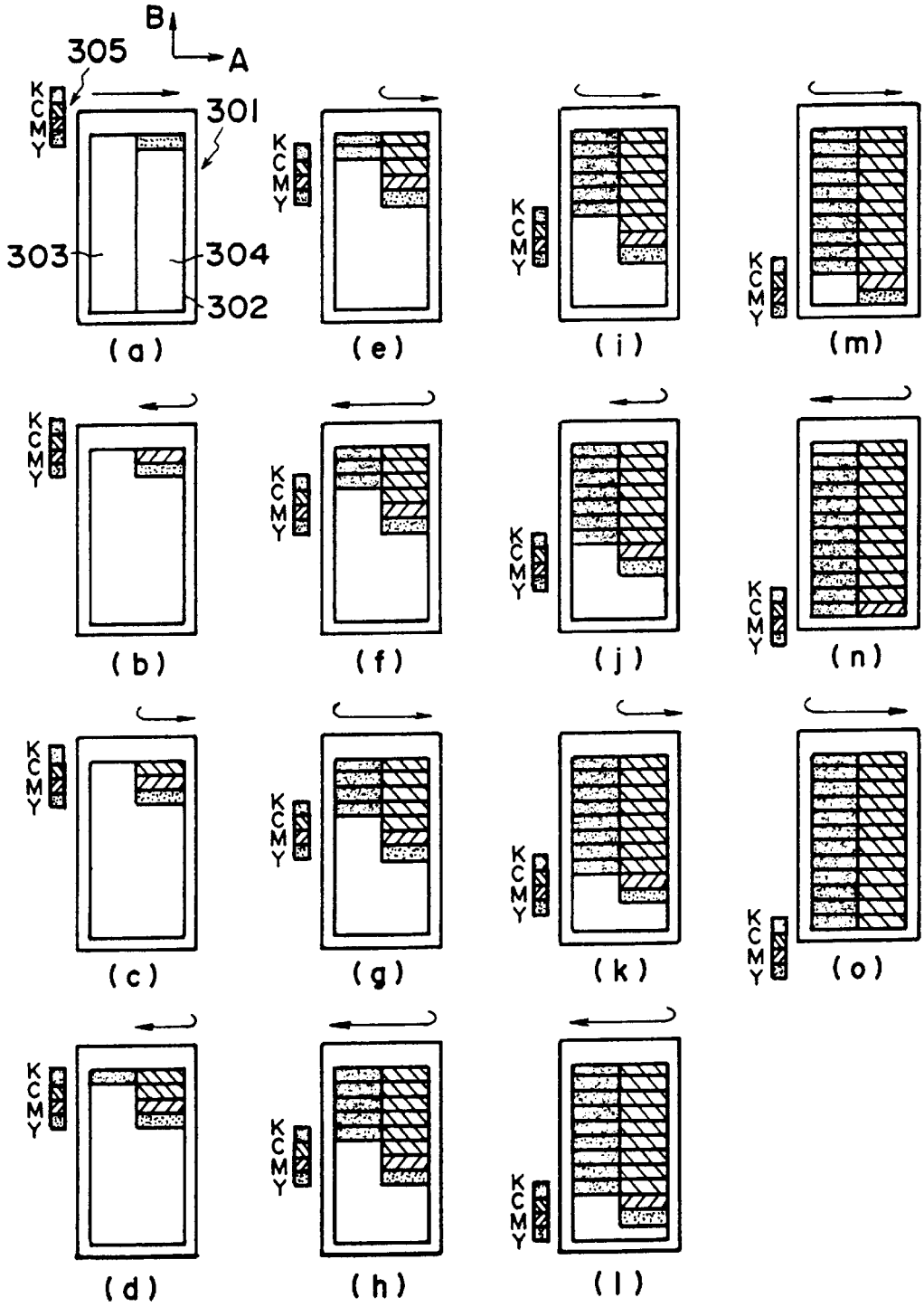
FIGS. 7A–7O illustrates a recording operation in a comparison apparatus.
Figure 8:
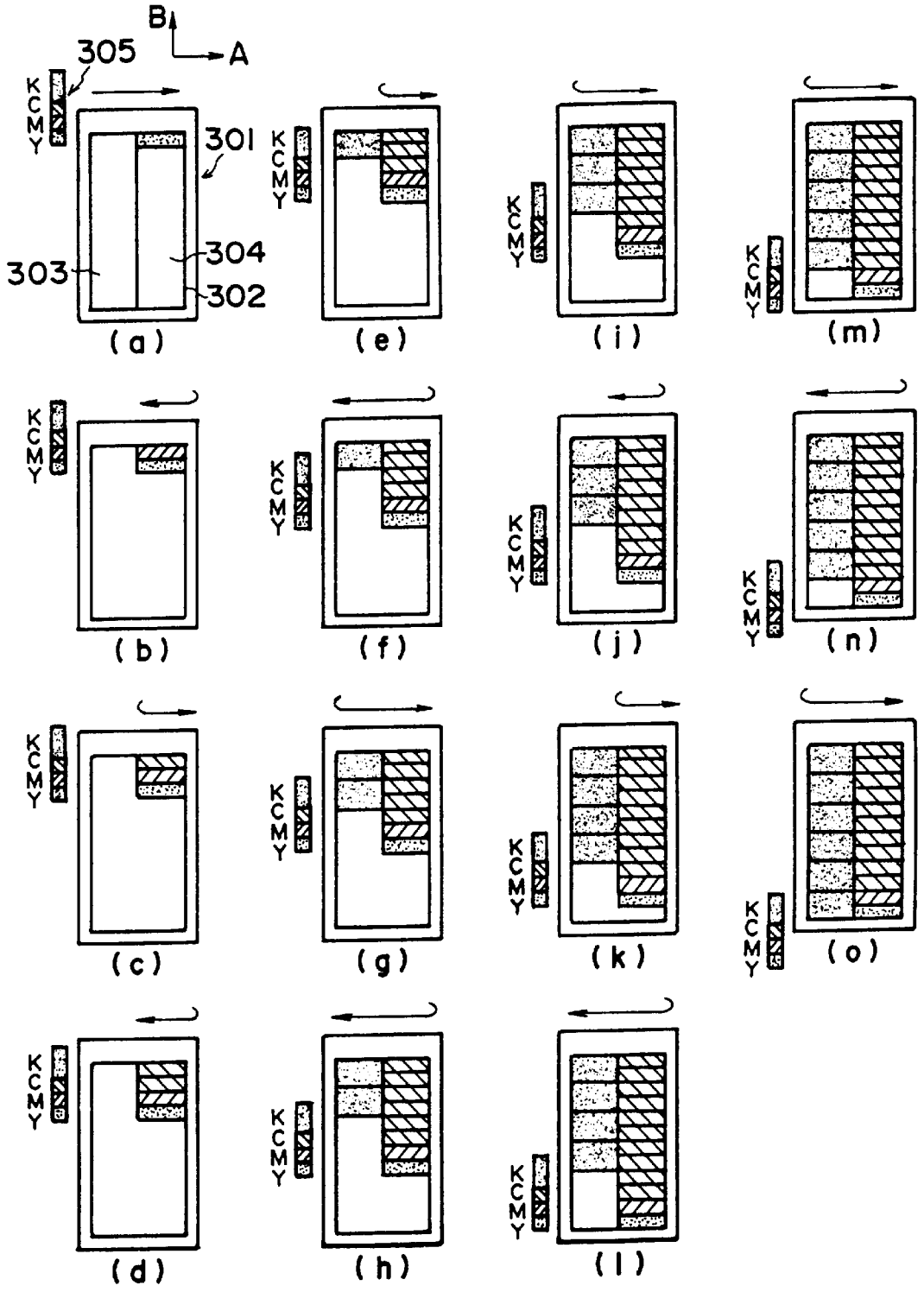
FIGS. 8A–8O illustrates a recording operation in the comparison example.
Figure 9:
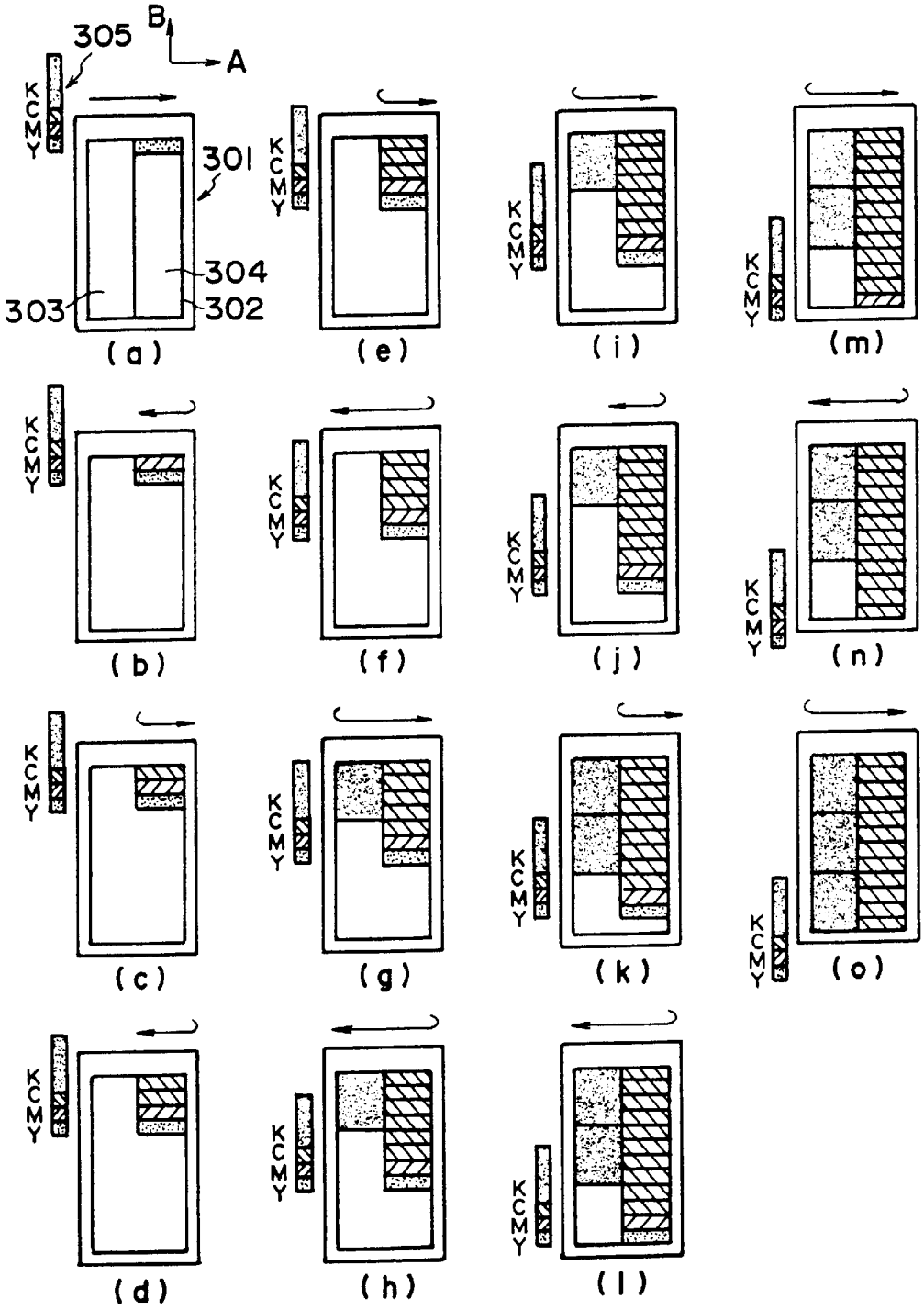
FIGS. 9A–9O illustrates a recording operation according to Embodiment 2 of the present invention.

FIGS. 6 and 9 illustrate a recording system according to Embodiment 2 of the present invention, and FIGS. 7 and 8 illustrate a recording system according to Comparison Example.

In FIGS. 6–9, the recording head 305 records a recording area 302 of the recording sheet 301. The recording head 305 has four ejection outlet groups Y (yellow), M (magenta), C (cyan), K (black). The numbers of ejection outlets of the groups Y, M and C are all equal, and the number of ejection outlets of the group K is an integer multiple (n times) of the number of ejection outlets of Y, M or C group. In the example shown in FIG. 6, n is 3, and in FIG. 7, n is 1, and in FIG. 8, n is 2, and in FIG. 9, n is 4.

In the examples shown in these Figures, the serial type is used in which the recording head 503 scanningly moves in a direction A In the Figure during the recording operation, while the recording sheet 301 is fed in the direction of sub-scan (arrow B). The movement distance in the sub-scan corresponds to a recording width of each of Y, M and C groups.

For the purpose of simplicity of the explanation, in FIGS. 6–9, the head 305 is indicated at a position adjacent the recording sheet 301 so that the relative positional relationship in the sub-scan direction between the head 305 and the recording sheet 301 is clear. This embodiment is based on the premise that the area 303 of the record data to be recorded by the ejection outlet group K and the area 304 to be recorded by Y, M, C ejection outlet groups, are divided as shown in the Figure in the main scan direction A. In this example, the ratio between is ½. In an example of such data, black characters or the like are recorded in ½ area, and color recording is effected in the remaining area. The ratio of the division is not limited to ½, but is described as being ½.

The structure of the head 305 is the same as that of FIGS. 2 and 3 (Embodiment 1) except for the number of ejection outlets and the arrangement thereof.

In FIGS. 6–9, what is common is that the recording with the black ink is carried out with the recording width of the ejection outlet group K. For example, as shown in FIG. 6, when the recording width of the ejection outlet group K is three times the recording width for the other three colors (x=3), the black ink recording with three times width is completed by one main scan operation. The description will be made as to FIG. 6 example.

In FIGS. 6, (*a*)–(*o*), show the processing of the recording operation by one main scan in this order.

The recording operation starts with yellow group in FIG. 6, (*a*). In (*b*), the M is overlaid on Y (YM), and Y is also recorded additionally. In (*c*), C is overlaid on YM in (*b*), and Y is overlaid on M, and additionally Y is also recorded. In (*d*), C is overlaid on YM in (*c*), and M is overlaid on Y, and Y is additionally recorded. In (*e*), C is overlaid on YM in (*d*), and M is overlaid on Y, and Y is additionally recorded. In the above (*a*)–(*e*), the recording operation covers only the color recording region, and the recording region of the recording sheet does not include any black recording in the recording width of the group K, and therefore, the black recording is not carried out. In this manner, when the recording with the black ink is not necessary, the main scan region is limited for that for the color region, namely, only ½ region is scanned.

In the subsequent recording operation (*f*), the full-width of the group K is in the recording area, and therefore, C is overlaid on YM in (*e*), and M is overlaid on Y, and additionally Y is recorded. Further additionally, the group K carries out its recording operation in the full-black recording width. The recording operations (*d*)–(*f*), are repeated until the recording operation covers the entire recording area at (*o*). As will be understood from FIG. 6, 15 main scan operations are carried out until the end of the recording. Among them, the main scan width is one half in 6 main scans ((*b*), (*c*), (*d*), (*e*), (*j*), (*k*)). The number of main scans with ½ width, and the number of ejection outlets for the black ink (K) and a ration n (integer) of the numbers of color ejection outlets, are particularly noted in this embodiment.

Referring to FIGS. 7–9, the description will be made in this respect. FIG. 7 deals with the case of n=1, that is, the number of black ejection outlets is the same as the numbers of ejection outlets of the respective colors. Similarly to FIG. 6, the recording operation is completed by 15 main scan operations, but the number of ½ width main scans is only two ((*b*) and (*c*)). In other words, as compared with the case of FIG. 6, the number of full width scan operations is larger by 4, and therefore, the recording operation period is longer, correspondingly.

FIG. 8 deals with the case of n=2. Similarly to the case of FIG. 6, the recording operation is completed by 15 main scan operations, but the number of ½ width main scan is only 2 ((*b*) and (*c*)) similarly to the case of FIG. 7 (n=1). Despite the doubling of the number of election outlets for the black ink, the time required for the recording is not improved.

FIG. 9 deals with the case of n=4. Similarly to the case of FIG. 6, 15 main scan operations is enough to complete the recording operation, and the number of ½ width main scan operations is 8 ((*b*), (*c*), (*d*), (*e*), (*h*), (*i*), (*l*) and (*m*)). Therefore, the time required for the recording can be decreased.

As will be understood from the foregoing, when n is an integer not less than 3 (FIGS. 6 and 9), the ratio of the number of ½ width main scan operations relative to the total number of the main scan operations, increases, and therefore, the reduction of the recording time is remarkable. In this embodiment, all of the black ejection outlets are always used, and therefore, the problem of the different service lives can be avoided.

In Embodiment 2, the order of arrangement of the four colors is K, C, M and Y, but the order of the colors may be any in this embodiment. For example, the order may be Y, M, C and K, and the number of the colors is not limited to 4. For example, the present invention is applicable to the case of three colors (K, red and blue), for example. In this case, the same advantageous defects can be provided if the number of the group K is n times ($n \geqq 2$) the number of ejection outlets for each of the other two colors. In other words, in this invention, it will suffice if the number of K ejection outlets is an integer (y), not less than the number of colors other than K, of the number of ejection outlets (m) for the colors other than K.

The present invention is not limited to an ink jet type recording system, but is applicable for any other recording system having recording elements for a plurality of colors. An example of the other recording system is thermal transfer recording type.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction or the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material.

The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

As will be understood from the foregoing, according to the present invention, the number of black ink ejection outlets beyond the number of another color ink ejection outlets can be used with deviation with a predetermined number, and they are used at once, and therefore, there occurs no service life difference among the individual black ink ejection outlets.

The number of ejection outlets used for the black and the other color recording can be always substantially the same, and therefore, the time required for processing the recording data can be reduced, or when the black ink is not ejected, the main scan range of the ink jet head can be reduced, so that the recording speed can be increased.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording method wherein ink is ejected onto a recording material, comprising the steps of:

providing an ink jet head having a predetermined number of first ejection outlets for ejecting black ink and a smaller number of second ejection outlets for ejecting ink different from the black ink;

effecting recording operation while scanningly moving the ink jet head in a direction different from a direction in which the recording material is fed, using m said second ejection outlets, and m+k or m−k said first ejection outlets, respectively, wherein m and k are positive integers;

feeding the recording material through a spacing distance between adjacent nozzles m×p, where p is an interval at which the ejection outlets are arranged;

shifting a range of use of the first ejection outlets in the direction of feeding of the recording material if m−k first ejection outlets have been used and contrary to the direction of feeding of the recording material if m+k first ejection outlets have been used; and repeating said recording, said feeding and said shifting steps.

2. A color recording apparatus comprising:

a recording head having a first number of first recording elements for effecting recording with black ink and a second and different number of second recording elements for effecting recording with ink different from the black ink;

scanning means for scanning a recording material with said recording head in a feed direction different from a scan direction in which said recording elements are arranged;

feeding means for feeding the recording material in the different direction through a width corresponding to the second number of second recording elements;

selecting means for selecting, for each scan of said scanning means, from said first recording elements the elements to be used during a period of scan by said scanning means, wherein the number of the selected elements is different from the second number of said second recording elements, and said selecting means shifting the selected elements, wherein the number of the selected elements is either m+k or m−k, and said selecting means shifts the selected elements by k, where m is the second number and k is the first number.

3. An apparatus according to claim 2, wherein said second recording elements eject the ink.

4. An apparatus according to claim 3, wherein said second recording elements eject the ink by thermal energy.

5. An apparatus according to claim 2, wherein the different ink is yellow, magenta or cyan ink.

6. An apparatus according to claim 2, wherein the recording head is detachably mounted to said apparatus.

7. An apparatus according to claim 2, further comprising a carriage for carrying the recording head.

8. An apparatus according to claim 2, wherein said apparatus is a copying machine.

9. An apparatus according to claim 2, wherein said apparatus is a facsimile machine.

10. An apparatus according to claim 2, wherein said apparatus is a terminal of a computer system.

* * * * *

UNITED STATES PATENT AND TRADEMARK OFFICE

CERTIFICATE OF CORRECTION

PATENT NO. : 6,022,096

DATED : February 8, 2000

INVENTORS : SHINICHI HIRASAWA, et al.

It is certified that error appears in the above-identified patent and that said Letters Patent is hereby corrected as shown below:

COLUMN 3

Line 31, "is a" should read --are-- and "view" should read --views--.

COLUMN 5

Line 24, "42th" should read --42nd--; and
Line 56, "is difference" should read --are different--.

COLUMN 7

Line 26, "election" should read --ejection--.

COLUMN 9

Line 9, "is" should read --in--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*